United States Patent [19]

Meissner et al.

[11] Patent Number: 4,459,763

[45] Date of Patent: Jul. 17, 1984

[54] TRAY DRYING CHAMBER

[75] Inventors: Dietrich Meissner, Berlin; Heinz Geisenhof, Weissenberg, both of Fed. Rep. of Germany

[73] Assignee: Schering Aktiengesellschaft, Berlin and Bergkamen, Fed. Rep. of Germany

[21] Appl. No.: 355,294

[22] Filed: Mar. 8, 1982

[30] Foreign Application Priority Data

Mar. 9, 1981 [DE] Fed. Rep. of Germany ..... 3109458

[51] Int. Cl.[3] ..... F26B 9/06

[52] U.S. Cl. ..... 34/75; 34/196; 34/204; 312/236

[58] Field of Search ..... 34/75, 77, 196, 197, 34/204, 216; 312/31, 229, 236, 273, 341

[56] References Cited

U.S. PATENT DOCUMENTS 1,282,822 10/1918 Harris ..... 34/216

2,899,189 8/1959 Matis et al. ..... 34/216

2,921,382 10/1957 Blum .

FOREIGN PATENT DOCUMENTS 2311637 5/1976 France .

2355258 6/1977 France .

127092 8/1927 Switzerland .

*Primary Examiner*—Larry I. Schwartz

*Assistant Examiner*—David W. Westphal

*Attorney, Agent, or Firm*—Millen & White

[57] ABSTRACT

A novel tray drying chamber having a tray-truck is provided, wherein moist material supported on the trays supported on the tray-truck are dried by the gas circulation method. The tray-truck and the drying chamber proper are constructed to form a functional unit, wherein the chamber-walls temperature controllable chamber walls and functionally cooperate with the external parts of the tray-truck to define gas-conducting passageways.

17 Claims, 3 Drawing Figures

TRAY DRYING CHAMBER

BACKGROUND OF THE INVENTION

This invention relates to a drying installation for thermal drying.

Conventional drying installations of a great variety of types are utilized for the thermal drying of moist goods on an industrial scale. Included among these are convection, tray-type, chamber-type, duct-type, tensionless, plate-type, rotary drum, sprinkler-type, perforated-belt, flash-type, atomizer-type, turbulence-type, fluidized-bed, agitator-type, contact, heated-plate, thin-film, roller-type, belt-type, sieve-drum, screw-type, tumbler, infrared, and freeze dryers. In all of these dryers, the adhereing residual moisture is conducted away in an accelerated fashion by means of heat supplied thereto.

When it is desired to dry filter cakes or centrifuge residues from chemical precipitation reactions, tray-type drying chambers with recirculated air are frequently employed. In these drying chambers, the moist material is typically spread on specially shaped plates, so-called trays, which in turn are stacked on racks. The racks in most cases include casters or other rolling means on the bottom, so that the term tray-trucks is commonly employed to describe this structure. The tray-truck filled with trays is normally exposed within the tray drying chamber to an air stream which has been heated in a separate heating register. The warm air stream is conducted in a manner such that the largest portion thereof, i.e. in the range of 70–80% , is recirculated, and the remaining, i.e. 20–30% of the air stream, is conducted to the outside. If the residual moisture content of the moist material to be dried also includes organic chemical solvents, instead of just water, then these solvents can be condensed in a separate condenser within the drying chamber, while the drying of the material is being conducted, in order to protect the environment. When the drying step is being conducted, loose particles of the material to be dried are usually, in part, entrained in dust form, preferably adhereing to the moist condenser in the chamber.

However, conventional drying chambers have the disadvantage that they do not often satisfy a number of strict requirements in conducting the drying process. For example, the guidelines for the production of pharmaceuticals are often not met by drying in the conventional type devices. Typically, the dust particles which are precipitated within the drying chamber, and preferentially on the ribs of the condenser, contaminate subsequent products dried therein. The dust deposits collecting in these devices can only be removed from the conventional drying chambers and associated accessories thereof, such as the condenser, cooling register, heating register, valves, and the conduits thereof, only after great expense and inconvenience.

SUMMARY OF THE INVENTION

It is thus an object of the present invention to provide a drying chamber having all parts arranged so that they can be readily and thoroughly cleaned in a manner so as to enable compliance with present day sanitary regulations for the production pharmaceutical final products.

This and other objects are provided by the invention which comprises a tray-truck drying chamber for drying moist material therein. The invention includes a drying chamber having the inner surfaces adapted for being temperature controlled. A fan is mounted within the ceiling of the drying chamber for causing circulation of a gaseous fluid within the chamber. A tray-truck which is structured for being positioned in the chamber is constructed in rectangular form. A closed rear wall is provided on the tray-truck and has a slot at the bottom thereof. Another wall is arranged in front of the rear wall and has openings arranged thereon so as to cause uniform flow distribution of the gaseous fluid within the chamber.

Upon further study of the specification and appended claims, further objects and advantages of this invention will become apparent to those skilled in the art.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DISCUSSION OF THE INVENTION

Figure 1:
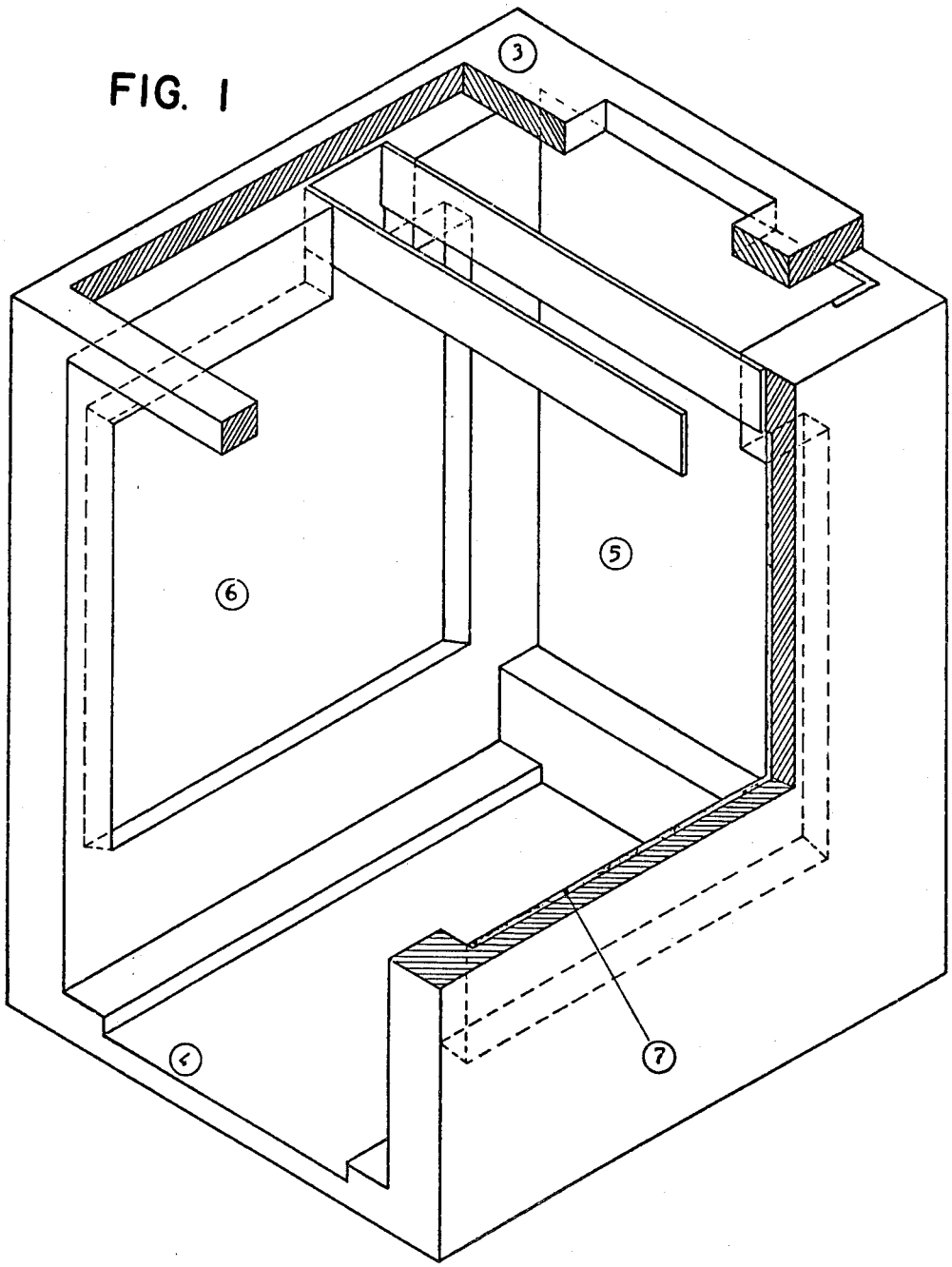
FIG. 1 is a partly broken away schematic view, in perspective, of the drying chamber of the invention.
Figure 2:
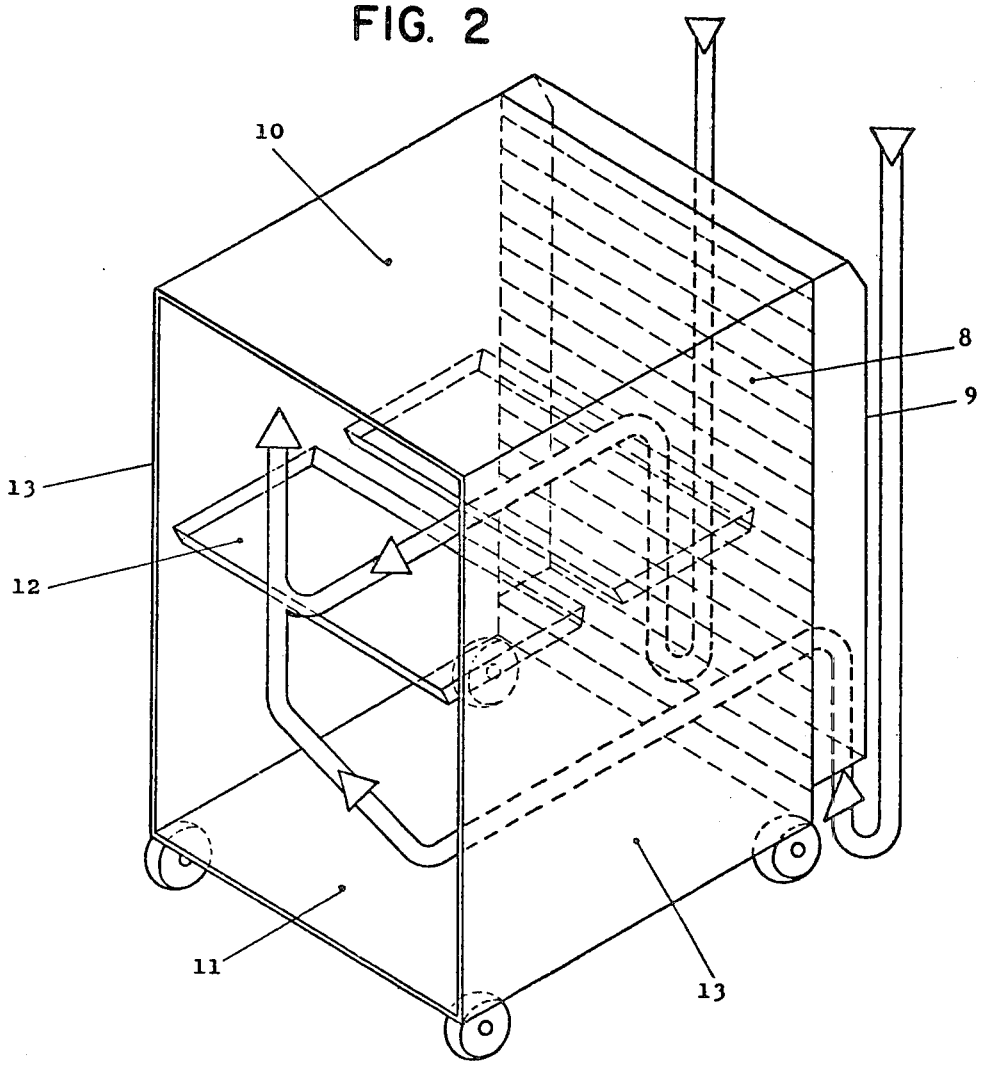
FIG. 2 is a schematic view of the tray-truck employed in the drying chamber of FIG. 1.

The drying chamber of the invention is comprised primarily of two functionally unitary parts. More specifically, these two parts are the drying chamber proper, illustrated in FIG. 1, and the tray-truck, illustrated in FIG. 2. The structure of the two parts are so functionally related that only when the tray-truck is positioned within the drying chamber proper, are the gas-conducting channels defined to establish the specific gaseous flow paths which are necessary to conduct the drying process properly and/or for the conducting the gas therethrough. When operatively assembled, the tray-truck and the drying chamber fit flush together.

The fitting is within the tolerance of manufacturing, practically, 1 to 5 mm. The clearance between the tray truck and the walls of the drying chamber effects a stray gaseous stream of 5 to 20%. This deviation must be compensated by an augmented amount of gas passing over the moist material. Optimal drying is achieved at a gas flow of 0.1 to 2 m/s.

The drying chamber is of a construction such that all walls, including the roof 3 and the floor 4, can be independently temperature-controlled. In a preferred construction, the drying chamber is constructed in a way such that the rear wall 5, and the two sidewalls 6 and 7 can be temperature-controlled. The walls are made of double-jacketed sheet metal, preferably stainless steel, through which the coolant, such as cooling water or cooling brine and/or the heating medium, such as hot water or steam, is conducted.

In addition to stainless steel, other materials can, of course, also be utilized. These materials must be thermally stable, and corrosion-proof when exposed to the residual moisture, i.e., they must be inert under the conditions of temperature and atmospheric content.

Accordingly, suitable materials include steel sheet, provided with an organic protective coating, such as varnish or "Teflon".

The tray-truck with casters or wheels is made up of closed side parts 13, a floor 11, and a roof 10. A rear wall 8 serves for regulating the direction of flow of the gaseous stream, and can be shaped as either one of a slotted wall, a finned wall, or a perforated wall. Thus, the rear wall 8 functions effectively as a control plate and will be referred to hereinafter as such. Baffle 9 is located spaced a predetermined distance behind the control plate 8, and the baffle is tightly sealed with respect to the roof but open toward the floor 11.

In a preferred arrangement, the tray plates 12 are supported in the tray-truck on guiding angle members attached to the sidewalls 13 of the tray-truck. This means for supporting the tray plates is not shown and is conventional in nature. Other support structures can also be used as will become obvious to the skilled artisan.

Figure 3:
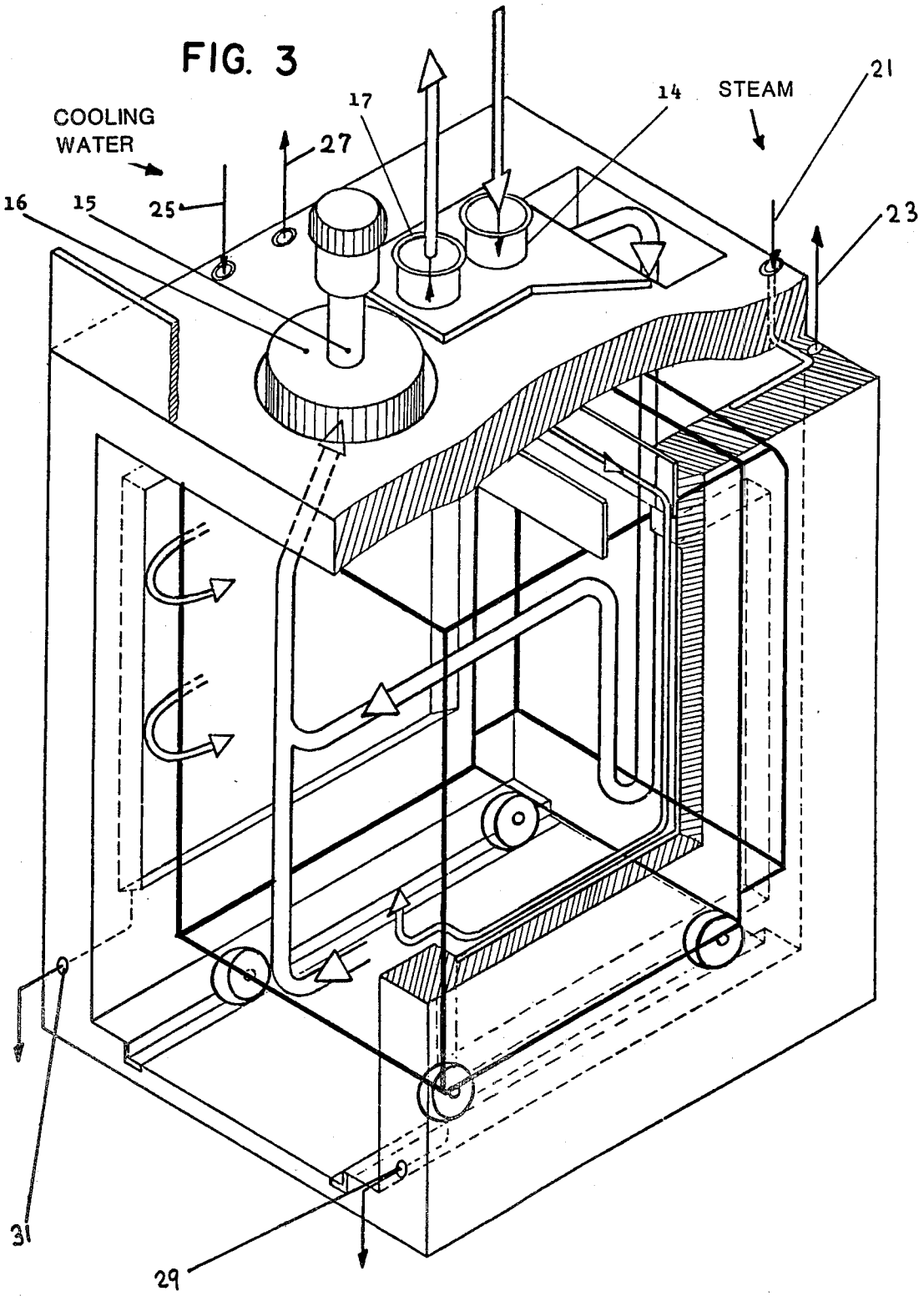
FIG. 3 is a partly broken away schematic view, in perspective, of the tray-truck inside the drying chamber in accordance with the invention wherein the flow of the gaseous stream is shown, and with the door not shown for reasons of clarity of illustration.

The operation of the drying chamber according to the invention is more clearly illustrated in FIG. 3. The filled chamber is tightly sealed by means of a door (not shown) which, if desired, can also be made temperature-controllable.

In one operation, if the product to be dried contains an organic solvent, then an inert gas, such as nitrogen, is first of all introduced through a sealable feeding nipple to create an inert atmosphere in the chamber 14 for obvious safety reasons.

A fan 15 with a vertically arranged shaft is located with the drive wheel 16 thereof integrally secured to the roof 3 of the drying chamber. The fan 15 serves to drive the gaseous stream along the heated rear wall 5 of the drying chamber, and the gaseous stream is heated as a result of this contact. The heated gas then rises through the space defined between the baffle 9 and the control plate 8 and is conducted through the control plate 8 and between the stacks of the tray plates 12, during which procedure the gas becomes saturated with the organic solvent which has been vaporized as a result of contact with the heated gas.

The gas then passes the zone between the door of the drying chamber and the front end of the tray-truck, as shown in FIG. 3, and the gas flows over the roof 10 of the tray-truck and below the roof 3 of the chamber past the drive wheel 16. After passing downstream of the drive wheel 16, and still upstream of the rear wall 5, a portion of the gaseous stream is branched off and conducted to the cooled sidewalls 6 and 7. The partial gas stream is diverted from the main stream behind the fan 15 by means of flaps, one for each wall 6 and 7, at an amount of 5 to 10%. The gas is cooled on the side walls to a temperature below the dew point of the gas stream, and the solvent is condensed thereon. The temperature control of the side walls is effected in accordance with the particular solvent present, and as can be seen, is conventional in nature. The condensate is then collected on the lower portions of the sidewalls 6 and 7, which are shaped so as to collect the liquid, and from there it is drained off by means of discharge outlets 29 and 31.

The main gaseous stream, with the separated partial stream recycled in contact with the floor, which can optionally be heated, and joined thereto, is recycled over the roof 3 to the heated rear wall 5, and the cycle is repeated until the moist product on the plates has a merely a residual moisture content, which can be determined by means of conventional sensor measuring the partial vapor pressure in the drying chamber.

The drying chamber of this invention can, of course, also be utilized for the drying of water-moist products with no organic solvents, in which case the drying step can be carried out with fresh air rather than an inert gas, and in this case the air is exhausted, after being circulated, through the sealable exhaust air nipple 17 by way of the roof. Thus, there is no requirement that the chamber be maintained totally sealed with respect to escaping gas because fresh air is plentiful and inexpensive to supply, whereas with an inert atmosphere, conservation of the inert gas containing gaseous organic solvents is desired.

When working with an inert atmosphere, the drying chamber is under pressure in the range of $10^{-3}$ to $2\times10^{-2}$ at.

As also shown in the figure, the top wall 3 and rear wall 5, and optionally the front door (not shown) and the floor, are associated with conduits extending to the double wall section thereof through which a hot fluid, such as steam, is supplied thereto by means of inlet 21, and removed by means of outlet 23. Likewise, the sidewalls 6 and 7 are cooled by a supply of cooling fluid such as cold water by means of inlet 25 and outlet 27.

The drying chamber of this invention has the advantage that, as compared to the prior art devices of comparable drying capacity, it is relatively small in size because auxiliary accessories, such as heating and/or cooling registers with the associated gas-conducting conduits are not required. Furthermore, all areas inside the chamber are readily accessible by simply moving the tray-truck out of the chamber, and thus, can be easily cleaned.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A tray-truck drying chamber for drying moist material therein comprising:

a drying chamber having the inner surface adapted for being temperature controlled, with at least one inner surface comprising means for being heated and at least one inner surface comprising means for being cooled;

fan impeller means mounted within the ceiling of the drying chamber for causing circulation of a gaseous fluid within the drying chamber; and a removable tray-truck having means for being positioned within the drying chamber when drying of materials on the tray-truck is to be conducted in a manner such that circulation of the gaseous fluid dries material thereon, and constructed in a rectangular form, said tray-truck having a closed rear wall having a slot opening at the bottom, and a wall arranged in front of and spaced from the rear wall, and having openings arranged therethrough in a manner such as to cause uniform distribution of the gaseous fluid within the drying chamber;

said gaseous fluid passes in contact with at least one of said heated surfaces before contacting said material on the tray-truck and a portion of the gaseous fluid passes in contact with at least one of said cooled surfaces before again passing in contact with at least one of said heated surfaces.

2. A tray-truck drying chamber according to claim 1 further comprising gas supply means for supplying the gaseous fluid to the inside of the drying chamber.

3. A tray-truck drying chamber according to claim 2, wherein said gas supply means comprises an inert gas supply source.

4. A tray-truck drying chamber according to claim 2, wherein said gas supply means comprises a fresh air supply adapted for supplying and withdrawing fresh air from the drying chamber.

5. A tray-truck drying chamber according to claim 1, wherein the side walls of the drying chamber comprise means for being cooled and the rear wall, floor and ceiling of the drying chamber comprise means for being heated, and wherein said drying chamber and tray-truck are arranged for ensuring circulation of a gaseous fluid sequentially in contact with the rear wall for heating, in contact with trays on the tray-truck for carrying off moisture from moist material therein, to contact the ceiling wherein a partial stream of the gaseous flow is separated to contact the side walls for causing condensation and collection of the moisture for removal thereof from the drying chamber, and to then contact the floor and rejoin the main stream in contact with the ceiling being circulated to the rear wall.

6. A tray-truck drying chamber according to claim 5 further comprising heat supply means for supplying a heating fluid to heat the rear wall and ceiling of the chamber, and cooling supply means for supplying a cooling fluid to cool the side walls of the chamber.

7. A tray-truck drying chamber according to claim 5 further comprising a front door which comprise means for being heated.

8. A tray-truck drying chamber according to claim 1, wherein said tray-truck further comprises roller means for facilitating movement of the tray-truck into and out of the drying chamber.

9. A tray-truck drying chamber according to claim 8, wherein said roller means comprise casters.

10. A tray-truck drying chamber according to claim 1, wherein said tray-truck comprises support means for supporting trays, upon which moist material to be dried is supported, at different levels on said tray-truck.

11. A tray-truck drying chamber for drying moist material therein comprising:

a rectangular tray-truck closed on all sides but the rear and front sides thereof;

said drying chamber having at least one inner wall thereof with means for being heated and at least one inner wall thereof with means for being cooled, and said drying chamber having a rectangular shape such that said tray-truck fits flush therein;

a fan integrated into the roof of said drying chamber in a manner for causing circulation of a main gaseous fluid stream within said drying chamber and said tray-truck;

said gaseous fluid stream passes in contact with at least one of said heated inner walls before contacting the moist material on the tray-truck;

means for separating a partial gaseous fluid stream from said main gaseous fluid stream and causing it to contact said at least one cooled wall; and discharge outlets associated with the side walls of the drying chamber at the bottoms thereof for removing condensed liquid resulting from said partial gaseous stream contacting said at least one cooled wall.

12. A tray-truck drying chamber as in claim 11, wherein the at least one inner wall with means for being heated is the rear wall of said drying chamber.

13. A tray-truck drying chamber as in claim 11, wherein the rear wall of said tray-truck comprises a baffle sealed with respect to the sides and the roof of said tray-truck.

14. A tray-truck drying chamber as in claim 13, wherein said tray-truck comprises control means for securing a uniform distribution of the gaseous fluid within the tray truck.

15. A tray-truck drying chamber as in claim 11, wherein both side walls of said drying chamber comprise means for being cooled.

16. A tray-truck drying chamber as in claim 11, wherein said drying chamber comprises sealable nipple means for introducing an inert gas thereinto.

17. A tray-truck drying chamber as in claim 11, wherein the roof of said drying chamber comprises sealable exhaust air nipple means for exhausting air and sealable feed nipple means for feeding fresh air into the interior of said tray-truck drying chamber.

* * * * *